United States Patent [19]

Matejczyk

[11] Patent Number: 4,710,223

[45] Date of Patent: Dec. 1, 1987

[54] INFILTRATED SINTERED ARTICLES

[75] Inventor: Daniel E. Matejczyk, Canoga Park, Calif.

[73] Assignee: Rockwell International Corporation, El Segundo, Calif.

[21] Appl. No.: 842,580

[22] Filed: Mar. 21, 1986

[51] Int. Cl.[4] ..... B22F 3/00

[52] U.S. Cl. ..... 75/248; 75/246; 75/248; 419/23; 419/27; 419/36; 419/37; 419/65

[58] Field of Search ..... 419/27, 36, 37, 65, 419/23; 75/246, 247, 248

[56] References Cited

U.S. PATENT DOCUMENTS

| | | | |
|---|---|---|---|
| 4,197,118 | 4/1980 | Wiech, Jr. | 75/228 |
| 4,314,399 | 2/1982 | Severinsson | 29/420 |
| 4,327,156 | 4/1982 | Dillon et al. | 428/568 |
| 4,431,449 | 2/1984 | Dillon et al. . | |
| 4,455,354 | 6/1984 | Dillon et al. . | |
| 4,491,558 | 1/1985 | Gardner . | |
| 4,554,218 | 11/1985 | Gardner et al. . | |

*Primary Examiner*—Stephen J. Lechert, Jr.

*Attorney, Agent, or Firm*—H. Fredrick Hamann; Harry B. Field; David C. Faulkner

[57] ABSTRACT

A sintered, metal infiltrated article and a method for preparing same is disclosed. The method permits mass production by injection molding, of metal infiltrated sintered articles of complex shape without excessive machining of the final product. The articles so produced have desirable physical properties such as abrasion resistance, high hardness, and high resistance to erosion at extreme temperatures encountered in use.

16 Claims, No Drawings

INFILTRATED SINTERED ARTICLES

BACKGROUND OF THE INVENTION

1. Technical Field

The present invention relates to powder metallurgy, injection-molded infiltrated precision articles, such as reaction engine or rocket nozzles, and rocket thrust chambers produced without machining or other mechanical shaping operations, and a process for forming said articles.

2. Background Art

Powdered metallurgy techniques have been used to produce infiltrated refractory metal articles having superior erosion and high-temperature resistance. Infiltrated articles are articles in which porosity in a body has been filled by a second phase. The second phase may be deposited in interconnected porosity of the first phase through melting, flowing in under pressure, or under capillary forces, and then solidifying, or it may be deposited by other means such as chemical vapor deposition.

A wear-resistant sintered alloy product is produced according to one method by mixing powders of an alloy, tungsten, and optional metals such as nickel. This mixture is packed in a mold to form a green product and sintered. Sintering the mixture forms a sintered product with a pearlite matrix microstructure. The sintered product is then infiltrated with either molten copper or a molten copper alloy to produce an infiltrated sintered product.

Another conventional method produces bodies composed of a refractory metal containing material as the major constituent, and an alloy matrix of a refractory metal in a metal or metals such as iron, nickel, copper, cobalt and chromium. The article or body is prepared by forming a porous sintered skeleton of refractory metal containing material, filling voids of the skeleton with a molten alloy containing a refractory metal, and then solidifying the molten alloy to provide the desired body.

The conventional methods for production of a complex-shaped infiltrated metal article of manufacture suffer from several disadvantages. One disadvantage encountered is the problem of shrinkage during the sintering of the article.

Also, in the case where a metal or metal alloy is infiltrated into a sintered skeleton or article, production of complex shapes is difficult or impossible because machining of the very hard and brittle material is difficult and expensive. A net or near-net shape process, such as injection molding, is needed for producing high quality sintered articles absent the aforementioned deficiencies.

DISCLOSURE OF INVENTION

Accordingly, the present invention overcomes the disadvantages inherent in known methods of production of infiltrated refractory material articles by providing a method for preparing a sintered powdered metal or rigid skeletal article with controlled shrinkage. The method of the present invention, which permits mass production of metal infiltrated sintered articles of complex shape without excessive machining of the final article comprises: mixing powdered metal with a binder, forming the mixture to a desired shape, removing the binder from the formed shape by solvent extraction to form a rigid skeletal article, the improvement comprising:

(i) controllably sintering the rigid skeletal article to less than theoretical density and forming interstices within the article;

(ii) infiltrating the skeletal article with a metal infiltrant according to the following steps:

(a) contacting the skeletal article with a metal infiltrant;

(b) controllably heating the skeletal article and the metal infiltrant under a reducing atmosphere to a temperature which is at least the melting point of the metal infiltrant;

(c) maintaining the temperature for a time sufficient for the infiltrant to infiltrate the skeletal article;

(d) controllably cooling the infiltrated skeletal article to solidify the metal infiltrant;

(iii) forming a metal infiltrated article; and (iv) recovering the infiltrated article so formed.

Accordingly, it is an object of the present invention to provide sintered metal composite articles such as rocket nozzles, thrust chambers and other similar components having desirable physical properties such as abrasion resistance, high hardness, and high resistance to erosion at high temperature.

Another object of the present inveniton is to provide a composite material for use in the manufacture of metal composite articles, and particularly, reaction engine components. These and other objects and features of the present invention will be apparent from the following detailed description.

DETAILED DESCRIPTION

A compact of a refractory metal containing skeleton, such as tungsten, is formed by mixing tungsten powder with a binder system and then injection-molding the binder metal mixture to the desired configuration and further process the binder metal mixture so as to have a density range of from about 70 to about 90 volume percent of theoretical density. The size of the particles of refractory metal of the compact may vary in accordance with the desired density of the finished body and with the desired pore size distribution in the skeleton. In the case of porous tungsten, the sintered part should consist of a porous skeleton with about 20% interconnected open porosity. A usual average particle size or the particles of the compact is from about 1 to about 10 microns.

The compact or green body of refractory metal is sintered at a temperature in the range of from about 1900° C. to about 2200° C. for from about 1 to about 20 hours to provide a skeleton.

Controllably sintering the complex shaped component or skeleton to a final density of less than 100 percent requires simultaneous control of component shrinkage and component porosity. Sintering temperature and furnace environment are critical and are carefully controlled. The correct sintering time and temperature are determined empirically through sintering trials. In the manufacture of the injection molding die, the sintering shrink factor must be known. An equation relating shrink factor to the initial batch composition and to the final sintered porosity of the component has been derived and verified, and this theoretical equation is useful in design of the die when empirical data on sintering shrinkage is unavailable.

The skeleton and the metal or metal alloy to be infiltrated (hereinafter infiltrant), prepared separately are placed in close proximity. At the high infiltration temperature, the infiltrant melts and is absorbed into the tungsten skeleton to fill void spaces therein. The infiltration step usually takes place in either a reducing atmosphere, such as hydrogen gas, or in a vacuum. After cooling, excess infiltrant, if any, is removed from the article.

Organic binders suitable for use in this invention are those which melt or soften at low temperatures, e.g. less than 180° C., preferably less than 120° C., thereby providing the metal powder-organic binder mixture with good flow properties when warmed and yet allowing the powder-binder mixture to be solid at room temperature so that a green article molded therefrom will not collapse or deform during handling. Preferably, during heating of the molded mixture of refractory granules and binder, the chosen binder gradually degrades or decomposes at a low temperature and leaves a minimal carbonaceous residue.

Examples of thermoplastic binders useful in the present invention include paraffin, a low molecular weight polyethylene, palm oil, lower alkyl esters, and mixtures of the aforementioned binders.

Representative solvents which can be used for leaching out the binder are ketones such as acetone or methylethyl ketone, an aqueous solvent.

The infiltrant in the final shaped article has a melting temperature below the melting temperature of the first metal or skeleton. Also, the infiltrant is a solid in the final article at room temperature. The infiltrant must also "wet" the skeleton. Wetting of the skeleton by the infiltrant can be determined empirically or by determining if the infiltrant will wet the skeleton according to the sessile drop test.

The infiltrant occupies from about 10 to about 30 volume percent of the final molded, infiltrated article. Suitable infiltrants include copper or copper alloys, such as a copper alloy consisting of 50% copper and 50% zirconium, and silver.

When a skeletal preform article is placed adjacent the above described infiltrant and heated to about the melting point of the infiltrant, the infiltrant will melt and "wick" into the interior of the preformed article. The time and temperature necessary to infiltrate the article will vary depending upon the choice of the infiltrant, the rate of heating, the wetting characteristics of the infiltrant, and the diameter of the pore-like passages or interstices within the skeleton.

The resulting infiltrated molded article, such as a copper infiltrated article, is substantially void-free (i.e., it has a density of at least 97% and usually 99% or more of the theoretical density based upon the densities of the constituents. Essentially the only uninfiltrated space in such an infiltrated article is the closed porosity of the original skeletal preform. The connected porosity of the original skeletal preform is essentially completely occupied by the infiltrant.

The following nonlimiting examples are illustrative of the preparation of sintered powdered metal articles containing an infiltrant.

EXAMPLE 1

First, a mixture of tungsten metal powder and binder was prepared by intimately mixing 50 percent by volume tungsten (powder particle sizes primarily between 3 μm and 5 μm) and 50 percent by volume plastic binder composed of a mixture of palm oil, polyethylene, steric acid and calcia for approximately three hours at 150° C. After the mixture cooled, it was crushed into small fragments so that it could be fed into a reciprocating screw injection molding machine. Molding of the shape of the final product or article, in this case a rocket engine nozzle, was carried out in this common injection molding machine in which the plastic/binder mixture was softened in a heating cylinder, injected into a closed die under a high pressure of approximately 70 MPa to 200 MPa, and allowed to cool in this die where it hardened. The dimensions of the die were the dimensions of the final article plus a factor to account for shrinkage that would occur in subsequent processing. This shrink factor is determined empirically, with the assistance of equations relating shrinkage to porosity that have been derived based on the assumption of constant tungsten volume in the mixture.

For this example of the molding of 50 percent by volume tungsten, and for the target final porosity of 20 volume percent, the shrink factor was 17 percent (shrink factor defined as (initial dimension − final dimension)/final dimension).

Next, the plastic/binder mixture was removed in a two step process of chemically dissolving and extracting the mixture by flushing in clean, flowing freon at 50° C., and then slowly thermally decomposing and flushing remaining mixture components by heating to 370° C. in flowing argon at a heating rate of 6° C./hour.

The article was next loaded into a sintering furnace. Molybdenum alloy fixtures or tools were used to control component shape by serving as a form that the final sintered article is in contact with. Because of stresses arising due to thermal gradients, the article can fracture during heating. This problem was minimized by surrounding the article with molybdenum sheet to serve as a heat shield that moderates thermal pulses and thermal gradients in the furnace. Without this heat shield, fabrication of relatively large, thin wall articles is not possible.

The article was heated to 1100° C. at a rate of approximately 100° C./hour. Hydrogen was then introduced and the temperature was held at 1100° C. for two hours to reduce tungsten oxide present. The furnace was then evacuated to a pressure of less than approximately $10^{-5}$ torr and the temperature was ramped at a rate of approximately 200° C./hour to the sintering temperature of 2150° C. This sintering temperature was held for 15 hours, then the temperature was lowered at a rate of 250° C./hour to ambient.

The product or rigid skeletal article produced by this sintering process was a porous tungsten body that has shrunk by 13.5 percent in going from it original tungsten composition of 50 volume percent to the final 77 volume percent tungsten. In repeated trials of this method, dimensions were repeatable to a tolerance of ±1%. Dimensions that must be held to a closer tolerance were controlled using the molybdenum tooling.

The component porosity was verified using measurements of the component weight dry, component weight with all interconnected porosity filled with water, and component weight filled with water and suspended in water. The measured values of interconnected porosity and total porosity were used to adjust sintering conditions in subsequent sintering runs.

The porous component or skeletal article was infiltrated with copper by placing the article in a graphite container in contact with approximately 140% of the amount of copper needed to fill the article porosity, and then heating to 1250° C. in a hydrogen atmosphere at a heating rate of approximately 300° C./hour, holding at this temperature for 2 hours, cooling at a rate of approximately 300° C./hour, and evacuating the furnace when the copper infiltrant has resolidified. The product or infiltrated article of this step was the net-shape, copper-infiltrated tungsten article. Some excess copper remained affixed to the lower portion of the article. This was removed in a single cutting step, that was facilitated by designing the article with generous excess material and a plane surface at this location.

The finished article or product had a composition of 77±2 volume percent tungsten, 21±1 volume percent copper, and 2±1 volume percent unfilled porosity. Final product dimensions that were established by sintering shrinkage were repeatable to within ±1%, and dimensions that were established by the molybdenum tool were repeatable to a smaller tolerance.

EXAMPLE 2

The method of Example 2 is the same as that of Example 1, except that in sintering, a furnace temperature of 2100° C. was held for 3 hours. All other details of the sintering process were essentially the same as those of Example 1. The product of this sintering was a porous tungsten body that has shrunk by 10 percent in going from its original tungsten composition of 50 volume percent to the final 70 volume percent tungsten.

Infiltration of the porous component with copper was carried out as in Example 1. The finished component has a composition of 70±1 volume percent tungsten, 29±1 volume percent copper, and 1±0.5 volume percent unfilled porosity. Final product dimensions were repeatable to the same degree as those in Example 1.

EXAMPLE 3

The method of Example 3 is the same as that of Example 2, except that the porous article is infiltrated with an alloy of 50 weight percent copper, 50 weight percent zirconium. This composition has in the past been shown to be useful because it is particularly oxidation resistant due to a protective zirconia surface layer that forms in the article surface under oxidizing, high temperature, high flow rate conditions.

The copper/zirconium alloy first was prepared by vacuum induction melting a mixture copper and zirconium. The porous article was infiltrated by placing it in a graphite crucible in contact with approximately 140% of the amount of the copper/zirconium alloy needed to fill the article porosity, and then heating to 1100° C. in a hydrogen atmosphere at a heating rate of approximately 300° C./hour, holding at this temperature for 2 hours, cooling at a rate of approximately 300° C./hour, and evacuating the furnace when the cooper/zirconium infiltrate has resolidified. As in Examples 1 and 2, excess infiltrant at the base of the article was removed in a single cutting operation.

The finished article or product had a composition of 70±1 volume percent tungsten, 14±1 volume percent copper, 14±1 volume percent zirconium, and 1±0.5 volume percent unfilled porosity. Final product dimensions were repeatable to the same degree as those in Examples 1 and 2.

Obviously, many modifications and variations of the present invention are possible in light of the above teachings. It is therefore to be understood that, within the scope of the appended claims, the invention may be practiced otherwise than as specifically described.

What is claimed and desired to be secured by Leters Patent of the United States is:

1. In a method for preparing a sintered powdered metal article comprising mixing powdered metal with a binder, forming the mixture to a desired shape, removing the binder from the formed shape by solvent extraction to form a rigid skeletal article, the improvement comprising:

(i) sintering the rigid skeletal article to a specific predetermined density, less than theoretical density, and thereby forming interstices within the article, according to the following sequential steps:
  (a) determining the article shrink factor as a function of initial batch composition, and as a function of article sintered density;
  (b) sintering at a combination of time and temperature to produce a selected article shrinkage during sintering;
  (c) using a refractory material fixture to further control article sintered dimensions;
  (d) using a refractory material heat shield surrounding the article during sintering to minimize thermal stresses; and
  (e) producing a rigid skeletal article having a density of from about 70% to about 90% of theoretical and a shrink factor of from about 10% to about 17% having final article dimensions controllable to about 1.0%;

(ii) infiltrating the skeletal article with a metal infiltrant according to the following steps:
  (a) contacting the skeletal article with a metal infiltrant;
  (b) heating the skeletal article and the metal infiltrant under a reducing atmosphere to a temperature which is at least the melting point of the metal infiltrant;
  (c) maintaining the temperature for a time sufficient for the infiltrant to infiltrate the skeletal article;
  (d) cooling the infiltrated skeletal article to solidify the metal infiltrant;

(iii) forming a metal infiltrant article; and (iv) recovering the infiltrated article so formed.

2. In a method for preparing a sintered article according to claim 1 in which the powdered metal mixed with the binder has a substantial particle size range of from about 3 microns to about 5 microns.

3. In the method of claim 1, in which the metal which is infiltrated into the sintered skeletal article is selected from copper, copper alloys, mixtures thereof, and silver.

4. In a method for preparing a sintered metal rocket engine component comprising mixing powdered metal with a binder, forming the mixture to a desired rocket nozzle shape, removing the binder from the formed shape by solvent extraction to form a rigid skeletal article, the improvement comprising:

(i) sintering the rigid skeletal article to a specific predetermined density, less than theoretical density, and thereby forming interstices within the article, according to the following sequential steps:
  (a) determining the article shrink factor as a function of initial batch composition, and as a function of article sintered density;
  (b) sintering at a combination of time and temperature to produce a selected article shrinkage during sintering;
  (c) using a refractory material fixtue to further control article sintered dimensions;

(d) using a refractory material heat shield surrounding the article during sintering to minimize thermal stresses; and (e) producing a rigid skeletal article having a density of from about 70% to about 90% theoretical and a shrink factor of from about 10% to about 17% having final article dimensions controllable to about 1.0%;

(ii) infiltrating the skeletal article with a metal infiltrant according to the following steps:

(a) contacting the skeletal article with a metal infiltrant;

(b) heating the skeletal article and the metal infiltrant under a reducing atmosphere to a temperature which is at least the melting point of the metal infiltrant;

(c) maintaining the temperature for a time sufficient for the infiltrant to infiltrate the skeletal article;

(d) cooling the infiltrated skeletal article to solidify the metal infiltrant;

(iii) forming a metal infiltrant article; and (iv) recovering the infiltrated article so formed.

5. In the method of claim 4 in which the powdered metal mixed with the binder has a substantial particle size range of from about 3 microns to about 5 microns.

6. In the method of claim 4, in which the metal infiltrant which is infiltrated into the sintered skeletal article is selected from copper, copper alloys, mixtures thereof, and silver.

7. In the method of claim 1 in which the powdered metal mixed with the binder is tungsten.

8. In the method of claim 4, in which the powdered metal mixed with the binder is tungsten.

9. An infiltrated article prepared according to the method of claim 1 in which the infiltrant occupies from about 10 volume percent to about 30 volume percent of the article so formed.

10. An infiltrated article prepared according to the method of claim 1 comprising a sintered infiltrated powdered metal article consisting essentially of tungsten infiltrated with about 21% by volume of copper.

11. An infiltrated article prepared according to the method of claim 1 comprising a sintered infiltrated powdered metal skeletal article consisting essentially of tungsten infiltrated with about 14% by volume of copper and about 14% by volume of zirconium.

12. An infiltrated article prepared according to claim 4 in which the infiltrant occupies from about 10 volume percent to about 30 volume percent of the article so formed.

13. An infiltrated rocket engine component prepared according to the method of claim 4 comprising a sintered infiltrated powdered metal article consisting essentially of tungsten infiltrated with about 21% by volume of copper.

14. An infiltrated rocket engine component prepared according to the method of claim 4 comprising a sintered infiltrated powdered metal article consisting essentially of tungsten infiltrated with about 14% by volume of copper and about 14% by volume of zirconium.

15. A method according to claim 1 which is an injection molding method.

16. A method according to claim 4 which is an injection molding method.

* * * * *